US005228697A

United States Patent [19]

Gulick et al.

[11] Patent Number: 5,228,697

[45] Date of Patent: Jul. 20, 1993

[54] GLOW-IN-THE-DARK GOLF BALL

[75] Inventors: James D. Gulick, Peoria, Ariz.; H. Lee B. Hollingsworth, Easton, Pa.

[73] Assignee: Sports Glow, Inc., Scottsdale, Ariz.

[21] Appl. No.: 823,150

[22] Filed: Jan. 21, 1992

[51] Int. Cl.[5] ..... A63B 43/06; A63B 37/12; A63B 37/06

[52] U.S. Cl. ..... 273/213; 273/DIG. 24

[58] Field of Search ..... 273/220, 218, 235 A, 273/DIG. 24, 213

[56] References Cited

U.S. PATENT DOCUMENTS

| | | | |
|---|---|---|---|
| 716,645 | 12/1902 | Ransom | 273/DIG. 24 |
| 2,738,616 | 3/1956 | Windle | 273/DIG. 24 |
| 3,634,280 | 1/1972 | Dean et al. | 273/213 X |
| 4,015,111 | 3/1977 | Spector | 273/DIG. 24 |
| 4,927,015 | 5/1990 | Jones | 273/DIG. 24 |
| 5,007,647 | 4/1991 | Gulic | 273/DIG. 24 |
| 5,018,742 | 5/1991 | Isaac et al. | 273/DIG. 24 |
| 5,080,359 | 1/1992 | Thill | 73/DIG. 24 |

FOREIGN PATENT DOCUMENTS

| | | | |
|---|---|---|---|
| 1176369 | 8/1986 | Japan | 273/DIG. 24 |

*Primary Examiner*—George J. Marlo
*Attorney, Agent, or Firm*—Harry M. Weiss

[57] ABSTRACT

A phosphorescent golf ball, which emits a glow of light, is provided, for ease of finding the ball in the dark. A method of manufacture is also provided. In the preferred embodiment, the golf ball includes a flexible core member having phosphorescent glow-in-the-dark glowing means to generate a glow of light and for emitting the glow of light that is visible in a dark environment after receiving at least one of light and heat energy and a transparent cover means encircling the flexible core member with its phosphorescent glow-in-the-dark glowing means for permitting the phosphorescent glow to pass through the transparent cover means to make the golf ball more visible. A phosphorescent core for a glow-in-the-dark golf ball is also disclosed which comprises a mixture of phosphorescent glow-in-the-dark materials and a flexible material such as rubber.

5 Claims, 1 Drawing Sheet

GLOW-IN-THE-DARK GOLF BALL

RELATED PATENT AND PATENT APPLICATION

This application is related to U.S. Pat. No. 5,077,647 which issued Apr. 16, 1991, title GOLF BALL AND METHOD OF MAKING SAME, inventor James D. Gulick, and is also related to the U.S. patent application Ser. No. 07/660,278, filed Feb. 22, 1991, entitled "GLOW-IN-THE-DARK GOLF BALL AND METHOD THEREFOR", inventor James D. Gulick.

FIELD OF THE INVENTION

This invention generally relates to golf balls and methods of manufacture thereof, and in particular this invention relates to glow-in-the-the dark golf balls and fabrication methods therefor.

BACKGROUND OF THE INVENTION

The conventional prior art golf ball usually includes a flexible (usually rubber) core member and a relatively hard (usually plastic) cover portion disposed over the flexible core member.

One problem with the conventional prior art golf ball is that it cannot be readily seen in the dark. Often, golfers seeking to finish a round of golf before darkness will try to rush through the last few holes in order to complete the round. In doing this, golfers will usually become frustrated because their rushed shots are generally not as good as their carefully stroked and planned shots. Also, golf balls are often lost because of darkness during attempts by golfers to finish their rounds.

One attempt to deal with this problem of playing golf at dark has been the development of a golf ball which had a hole drilled through the ball for the insertion therein of glow type material which made the golf ball easier to see at dusk or even during darkness U.S. Pat. No. 4,695,055 discloses this prior golf ball with a hole therethrough.

Various problems are associated with this type of a golf ball. First of all, a golfer usually has to use more than one of these glow type material inserts for this type of golf ball to fully complete 18 holes of golf. Furthermore, this type of golf ball is structurally changed thereby eliminating any chance of being approved by the U.S.G.A. (United States Golf Association) which is the official group that rules on which golf balls are acceptable as official golf balls to be used in golf tournaments. Also, people using this prior golf ball have indicated that they cannot hit the ball as far as conventional golf balls.

A number of other, non-related objects (not golf balls) have had phosphorescent materials applied such as disclosed in U.S. Pat. No. 3,445,551 covering a hollow, expanded ball, but not a golf ball.

Thus, a definite need existed for a phosphorescent glow-in-the-dark golf ball that could be approved by the U.S.G.A., and that can be hit as far as conventional golf balls, but which would be useful to golfers either seeking to finish their golf play at dusk, or for playing at night (with some exterior golf course lights to outline the general layout of the golf course including any ponds, trees, bushes, etc. to avoid injury to the golfer), or for playing golf where there are out of bound areas with relatively tall grass making normal (non-glowing) golf balls difficult to see, or for playing golf near water hazards such as small ponds that can conceal the location in the water of (non-glowing) golf balls, but might reveal the location of a glowing type golf ball.

SUMMARY OF THE INVENTION

Accordingly, it is an object of this invention to provide improved phosphorescent glow-in-the-dark golf balls and fabrication methods therefor.

It is a further object of this invention to provide improved phosphorescent glow-in-the-dark golf balls and fabrication methods therefor where these golf balls glow without structural changes thereto.

It is still another object of this invention to provide improved phosphorescent glow-in-the-dark golf balls and fabrication methods therefor which are capable of being approved by the U.S.G.A. for golf tournaments or as an official golf ball.

It is a still further object of this invention to provide improved phosphorescent glow-in-the-dark golf balls and fabrication methods therefor which utilize a phosphorescent glow-in-the-dark core and an encircling transparent cover which functions to permit light to pass through the transparent cover to energize the phosphorescent glow-in-the-dark core and to permit a phosphorescent glow of light to pass from the core out through the transparent cover to make the golf ball visible in a dark environment.

It is still another object of this invention to provide improved phosphorescent glow-in-the-dark cores for glow-in-the-dark golf balls and fabrication methods therefor.

According to one embodiment of the present invention, a glow-in-the-dark golf ball is provided which comprises a flexible core member having phosphorescent glow-in-the-dark glowing means for receiving at least one of light and heat energy to generate a glow of light and for emitting the glow of light that is visible in a dark environment after receiving at least one of light and heat energy, and transparent cover means encircling the flexible core member with its phosphorescent glow-in-the-dark glowing means for permitting the phosphorescent glow to pass through the transparent cover means to make the golf ball more visible.

According to another embodiment of the present invention, a method of providing a glow-in-the-dark golf ball is provided which comprises the steps of: providing a flexible core member having phosphorescent glow-in-the-dark glowing means for receiving at least one of light and heat energy to generate a glow of light and for emitting the glow of light that is visible in a dark environment after receiving at least one of light and heat energy, and forming transparent cover means encircling the flexible core member with its phosphorescent glow-in-the-dark glowing means for permitting the phosphorescent glow to pass through the transparent cover means to make the golf ball more visible.

A still another embodiment of this invention is a glow-in-the-dark core for a glow-in-the-dark golf ball which comprises a flexible core member having phosphorescent glow-in-the-dark glowing means for receiving at least one of light and heat energy to generate a glow of light and for emitting a glow of light that is visible in a dark environment after receiving at least one of light and heat energy.

The foregoing and other objects, features and advantages will be apparent from the following description of the preferred embodiment of the invention as illustrated in the accompanying drawings.

DESCRIPTION OF THE PREFERRED EMBODIMENT

Figure 1:
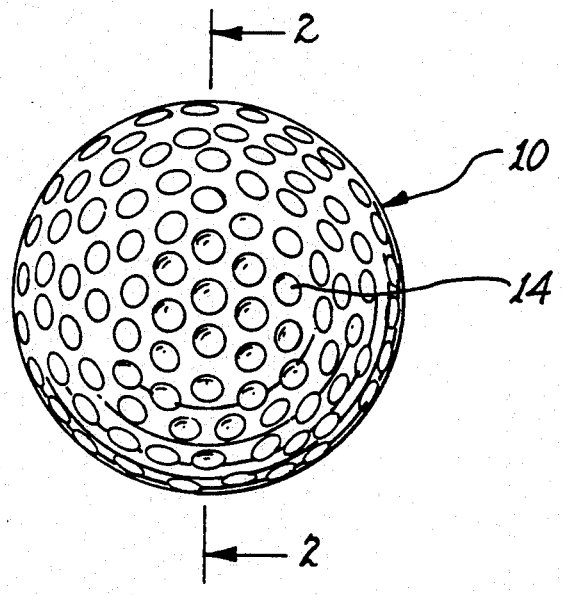
FIG. 1 is an elevation view of a golf ball according to the invention.
Figure 2:
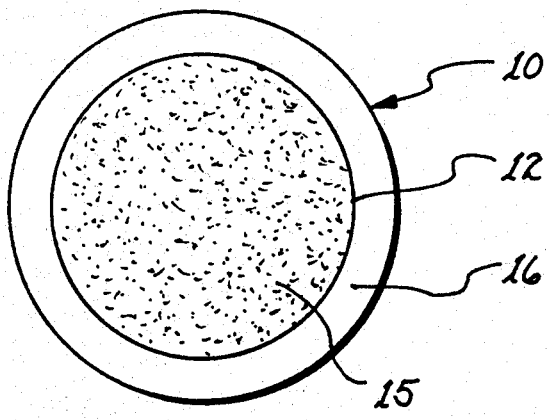
FIG. 2 is a section view taken along line 2—2 of FIG. 1.

As shown in FIGS. 1 and 2, a golf ball 10 is provided. Golf ball 10 has, like many conventional golf balls, a center ball type core 12 (see FIG. 2) and an exterior dimpled surface 14 (see FIG. 1). Thus, golf ball 10 has a flexible, resilient core or core portion 12 which is preferably made of a flexible (i.e. rubber) ball type material as further described below. The flexible core 12 comprises a sphere or spherical member preferably made of conventional rubber type material (polybutadiene) mixed with phosphorescent glow-in-the-dark materials such as disclosed in the above referenced James D. Gulick U.S. Pat. No. 5,007,647 which mixture of the rubber type material and the phosphorescent glow-in-the-dark materials are mixed together and compressed together into the flexible core sphere 12 shown in FIG. 2.

Golf ball 10 also includes a plastic exterior layer 16, which is composed of a translucent, transparent, clear plastic material such as the material sold under the tradename SURLYN by DuPont. This plastic material or layer 16 can be formed about the flexible core 12 by various known plastic forming techniques at elevated temperatures.

The advantage of the glow-in-the-dark or luminescent golf ball 10 of FIGS. 1 and 2 have been indicated above. Golf ball 10 is relatively easy to find in the dark, as during an evening golf game after sunset, because it emits a phosphorescent glow after light is used (such as from a flashlight or bulb) to activate the flexible core 12 which contains the phosphorescent glow-in-the-dark materials therein. Thus, the golf ball 10 can be made to provide a glow of light by applying an exterior light through the external transparent cover wherein the generated or exited glow from the flexible core 12 containing the phosphorescent materials will pass from the core 12 through the transparent, plastic layer 16 to thereby make the golf ball 10 visible at night or in a dark environment.

An advantage of the golf ball 10 is that the cost of producing such a golf ball is not very high considering the glow-in-the-dark feature thereof.

The flexible core 12 is made of a mixture of flexible material such as rubber (polybutadiene) with the phosphorescent glow-in-the-dark materials in a percentage ratio wherein the phosphorescent glow-in-the-dark material comprises a percentage of the mixture and the flexible material (such as rubber) is also a percentage of the mixture. In one embodiment, the phosphorescent glow-in-the-dark material comprised in the range of from about 25 to about 80 parts of the mixture, the flexible material was polybutadiene which was about 100 parts of the mixture and the remaining parts of the mixture was about 37 parts of Zinc Diacrylate and about 1 part of Peroxide. The phosphorescent glow-in-the-dark materials in the core mixture are generally designated by reference number 15 in FIG. 2

While the invention has been described in its preferred embodiments, it is to be understood that the words which have been used are words of description rather than limitation and that changes may be made within the purview of the appended claims without departing from the true scope and spirit of the invention in its broader aspects.

The embodiments of an invention in which an exclusive property or right is claimed are defined as follows:

1. A spherical, two-piece, phosphorescent glow-in-the-dark golf ball comprising:

a spherical, solid core including a resilient material having phosphorescent glow-in-the-dark glowing means mixed throughout said core material for receiving at least one of light and heat energy to generate a glow of light and for emitting said glow of light that is visible in a dark environment after receiving said at least one of light and heat energy; and a spherical, transparent cover means encircling said flexible core for permitting the phosphorescent glow of said core to pass through the transparent cover means to make the golf ball more visible.

2. The phosphorescent glow-in-the-dark golf ball of claim 1 wherein said transparent cover means is a layer of clear, translucent plastic material.

3. The phosphorescent glow-in-the-dark golf ball of claim 1 wherein said core comprises a mixture of at about 100 parts of said resilient material and at least about 25 parts of phosphorescent glow-in-the-dark materials.

4. The phosphorescent glow-in-the-dark golf ball of claim 3 wherein a range of from about 25 to about 80 parts of said phosphorescent glow-in-the-dark material sis mixed with said resilient material.

5. The phosphorescent glow-in-the-dark golf ball of claim 1 wherein said resilient material is rubber.

* * * * *